US008919003B1

(12) United States Patent
Shoham

(10) Patent No.: US 8,919,003 B1
(45) Date of Patent: Dec. 30, 2014

(54) PARALLEL STRAIGHTEDGE DRAFTING BOARD

(71) Applicant: Jonathan C Shoham, Simsbury, CT (US)

(72) Inventor: Jonathan C Shoham, Simsbury, CT (US)

(73) Assignee: FSM Plasticoid Manufacturing, Inc., East Windsor, CT (US)

( * ) Notice: Subject to any disclaimer, the term of this patent is extended or adjusted under 35 U.S.C. 154(b) by 219 days.

(21) Appl. No.: 13/672,664

(22) Filed: Nov. 8, 2012

Related U.S. Application Data

(60) Provisional application No. 61/597,968, filed on Feb. 13, 2012.

(51) Int. Cl.
*A47B 27/00* (2006.01)
*B43L 13/02* (2006.01)

(52) U.S. Cl.
USPC ..... 33/444; 33/42; 33/1 M

(58) Field of Classification Search
USPC ..... 33/32.1, 32.3, 41.1, 42, 430, 444, 448, 33/1 M, 433
See application file for complete search history.

(56) References Cited

U.S. PATENT DOCUMENTS

| | | | | |
|---|---|---|---|---|
| 3,826,006 | A * | 7/1974 | Rushin | 33/437 |
| 4,254,556 | A * | 3/1981 | Anav | 33/437 |
| 4,383,375 | A * | 5/1983 | Avella et al. | 33/437 |
| 4,625,410 | A * | 12/1986 | Eder | 33/438 |
| 4,738,029 | A * | 4/1988 | Held | 33/1 M |
| 5,530,207 | A * | 6/1996 | Dolling | 178/18.01 |
| 6,851,201 | B1 * | 2/2005 | Gioia et al. | 33/42 |
| 2002/0066195 | A1 * | 6/2002 | Gwon | 33/437 |
| 2004/0143979 | A1 * | 7/2004 | Albright et al. | 33/42 |
| 2013/0099438 | A1 * | 4/2013 | Mann | 33/484 |
| 2013/0305546 | A1 * | 11/2013 | Segreti | 33/32.7 |

* cited by examiner

*Primary Examiner* — G. Bradley Bennett
(74) *Attorney, Agent, or Firm* — Donald J. MacDonald; Coleman & MacDonald Law Office

(57) ABSTRACT

A portable, parallel straightedge drafting board is disclosed which utilizes a unique wire arrangement with control locks attached thereto to achieve a movable straightedge that will always be parallel to itself when moved during use of the drafting board.

16 Claims, 2 Drawing Sheets

PARALLEL STRAIGHTEDGE DRAFTING BOARD

RELATED APPLICATION

This utility patent application claims benefit under U.S. Provisional Patent Application No. 61/597,968, entitled "Parallel Straightedge Drafting Board", filed on Feb. 13, 2012.

FIELD OF THE INVENTION

This invention relates to drafting boards and more particularly to a cord mounted straightedge assembly in proper movable position on a drafting board.

BACKGROUND OF THE INVENTION

In the prior art, portable drafting boards have moveable straightedges that maintain a fairly good parallel orientation as the straightedge moved up and down the drafting board. However, the mechanisms for maintaining parallel orientation of the straightedge as is it moved have limited compensation for any error on the left side of the drafting board to the right side of the board to maintain the straightedge parallel to previous positions as it is moved.

SUMMARY OF THE INVENTION

A straightedge drafting boards is described that is simple in design but has the ability to maintain a straightedge mounted on the drafting board in continuous parallel orientation as the straightedge is moved up and down the board.

To provide for this compensation a single cord is connected between the left and right side edges of the drafting board and the left and right ends of the straightedge are connected to this cord. Any position of the single cord and the left end of the straightedge connected thereto along the left side of the drafting board is reflected via the single cord to the position of the single cord along the right side of the drafting board. This better maintains the straightedge mounted on the drafting board in continuous parallel orientation as the straightedge is moved up and down the board.

DESCRIPTION OF THE DRAWING

The invention will be better understood upon reading the following Detailed Description in conjunction with the drawing in which.

DETAILED DESCRIPTION

Figure 1:
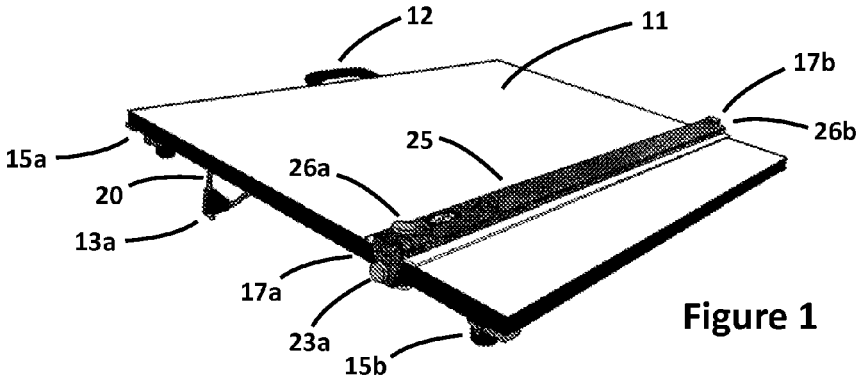
FIG. 1 is a perspective view of the drafting board when it is set up.
Figure 2:
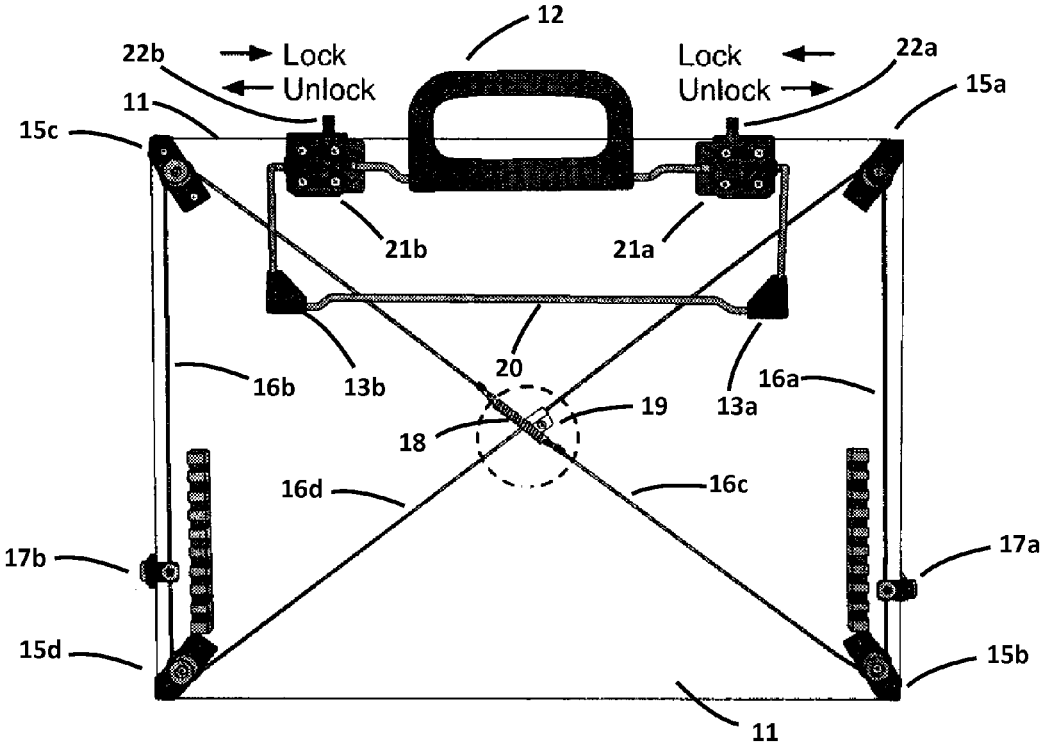
FIG. 2 is a bottom view of the drafting board showing how a single cord is routed and is connected to either end of a straightedge.

In FIG. 1 is a perspective view of the drafting board assembly 10 when it is set up for use. Board assembly 10 comprises a flat board 11 having a carrying handle 12 that used to both carry board assembly 10, and also to rotate a rod elevation piece 20 from a position folded up against the bottom of board 11, as shown in FIG. 2, to the extended position as shown in FIG. 1. Handle 12 is firmly fixed to rod elevation piece 20. On the bottom corners of rod elevation piece 20 are feet 13*a* and 13*b*, one toward each side of the board 11. In their extended position, as shown in FIG. 1, rod elevation piece 20 is locked in its extended position by two snap lock mechanisms 21 (not shown in FIG. 1) on the bottom of board 11. Snap lock mechanisms 21 are shown in and described with reference to FIGS. 2 and 4.

In FIG. 1 are shown pulley 15*a* in the upper left of drafting board assembly 10 and pulley 15*b* in the lower left corner of board 11. There is a duplicate pulley 15*c* (not shown in FIG. 1 but shown in FIG. 2) in the upper right corner of drafting board assembly 10 and another pulley 15*d* (also not shown in FIG. 1 but shown in FIG. 2) in the lower right corner of board 11. The pulleys 15*a*-15*d* are described in greater detail with reference to FIG. 2. Also shown is straightedge 25 which can slid up and down board 11 and remain parallel to all previous positions of straightedge 25. When in a particular, desired position straightedge 25 is locked in that position using edge locks of control elements 17*a* and 17*b* which are shown in and described in greater detail with reference to FIG. 3.

Straightedge 25 is made of extruded and machined aluminum and a novel control element 17*a* attached to the left end and control element 17*b* attached to the right end thereof. Control elements 17*a* and 17*b* includes other elements that are shown in and described with reference to FIG. 3. Control element 17*a* is mounted on the left edge of board 11 and control element 17*b* is mounted on the right edge of board 11. On control element 17*a* is shown a brake knob 23*a* and a top adjustment knob 26*a*, and on control element 17*b* is shown a brake knob 23*b* and a top adjustment knob 26*b*. The function of the knobs are described with reference to FIG. 3.

FIG. 2 shows a bottom view of the drafting board 10 showing how a single cord 16 is routed around the edges of board 11 and is connected to either end of straightedge 25 (not seen in this Figure) by control elements 17*a* and 17*b*.

There is also rod elevation piece 20 that is made of rigid steel rod so it will not easily bend. Rod elevation piece 20 is formed in a closed loop as shown and handle 12 firmly attached to the middle of the top of the loop as shown. A piece of the loop of elevation piece 20 passes through snap lock mechanisms 21*a* and 21*b* as shown, where it is held by a cover. The snap lock mechanisms 21*a* and 21*b* are each fastened to the underside of board 11 where shown. Attached to the lower corners of closed loop rod 20 are feet 13*a* and 13*b* which provide friction preventing or limiting movement of drafting board 10 when it is set up on a table or other surface. Snap locks 21*a* and 21*b* are better shown in and described with reference to FIG. 4.

In each of the four corners of board 11 is fastened a wire guide 15*a*, 15*b*, 15*c*, 15*d*, each wire guide consisting of a plate with a small pulley attached thereto. The axis of the shaft on which the pulleys are mounted extends downward from and perpendicular to board 11. There is also another, different wire guide 19 fastened to the bottom center of board 11. More particularly, each wire guide fits over one of the corner edges of board 11 before it is fastened to the underside of the board.

There is a piece of wire cable 16 that is passed around wire guides 15*a*-15*d* in the corners of board 11 and through wire guide 19 in an "X" pattern as shown in FIG. 2. This wire cable and its routing is part of the present invention. Initially, before being fastened into a closed loop, wire 26 is routed around each if the wire guides 15*a*-15*d* and through wire guide 19 in the "X" pattern shown in FIG. 2.

The two ends of wire 16 are shown fastened together and centered above wire guide 19 but they may off to one side of the wire guide. The two ends of wire 16 are then fastened to the two ends of a stretched spring 18. To do this one end of wire 16 is attached to a first end of spring 18 using an eyelet (not shown). The other end of wire 16 also has an eyelet (not shown) attached thereto. Spring 18 is stretched approximately 1 inch beyond its un-stretched length and the eyelet attached to the other end of wire 16 is attached to the other end of spring 18. More particularly, in FIG. 2 the portion of wire 16 passing between the lower left corner of board 11 to the upper right corner of board member 11 passes through wire guide 19. In this manner spring 18 does not contact the piece of wire 16 passing through wire guide 19.

Wire 16 is positioned on and fastened to novel control elements 17*a* and 17*b* on the edges of board 11 as shown in FIG. 2. Control element 17*a* is mounted on the left edge of board 11 and control element 17*b* is mounted on the right edge of board 11. This is shown in and described in greater detail with reference to FIG. 3.

Figure 3:
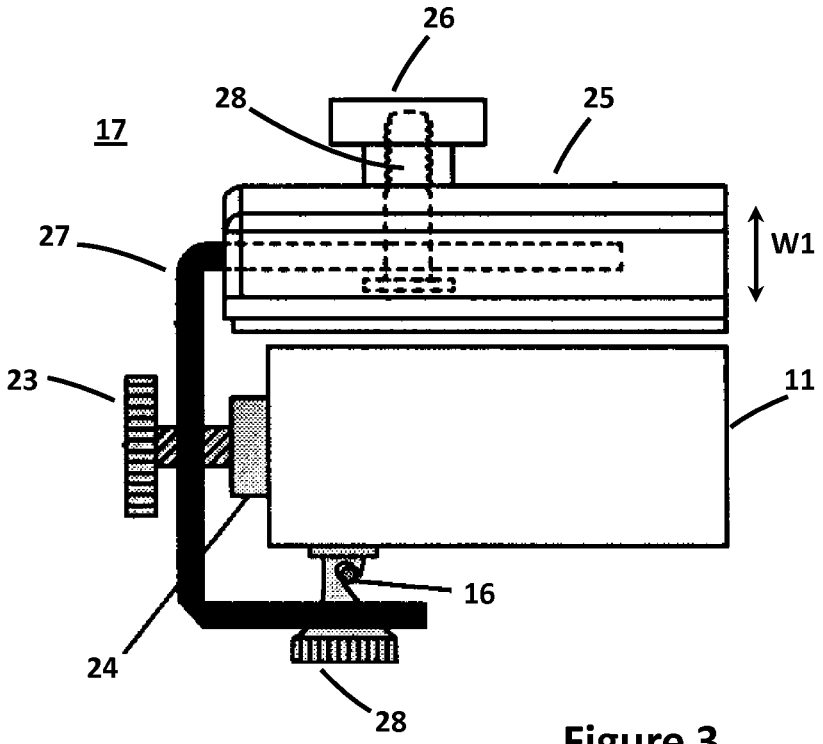
FIG. 3 is a side view of one of two adjustment bracket and brake knob mechanisms, one being connected to either end of a straightedge and to the single cord as it is positioned along either side of the drafting board.

In FIG. 3 is shown a control element 17 and there is one (17*a*) mounted on the left side of board 11 and one (11*b*) mounted on the right side of board 11 as shown in FIG. 1. Element 17 has a wire capture screw 28 on its bottom, a brake knob 23 on its side and a top adjustment knob 26 on its top. All these screws and knobs are mounted on a side bracket 27 that has a "U" shape and is positioned sideways as shown to fit over an edge of board 11 as shown in FIGS. 1 and 2. Straightedge 25 has a slot in either end thereof and one of the two control elements 17*a* and 17*b* is mounted to each end of straightedge 25. For both elements 17*a* and 17*b* the upper side of bracket 27 fits into the slot and knob 26 is tightened to firmly hold the top of side bracket 27 to the top side of straightedge 25. There is a control element 17*a* and 17*b* attached to either end of straightedge 25, as shown in FIG. 1, in this manner.

Brake knob 23 on the side edge of control element 17 has a knurled outer end that is turned by hand, and an inner end to which is affixed a brake pad 24 adjacent to board 11. When straightedge 25 with control elements 17*a* and 17*b* attached thereto is mounted on a board 11 the side bracket 27 of both control elements are adjusted and tightened to have room for the two brake knobs 23 to be turned both in and out, and then the two top adjustment knobs 26 are locked.

To lock the loop of wire 16 to each control element 17 wire capture screw 28 is utilized. As shown in FIG. 3 wire 16 is forced into a slot near the inner end of screw 28 where the wire is captured and tightly held. Wire 16 may also be attached to screw 28 in alternative ways. Straightedge 25 is carefully positioned on board 11 before wire 16 is fastened to wire capture screw 28. When board 11 is in use the flat end of screw 28 rests against and rides along the bottom edge of board 11.

Brake knob 23 is mounted through the side wall of side bracket 27 and on its inner end is a brake pad 24 that rests against the side wall of board 11. More particularly, pad 24 of brake knob 23 of control element 17*a* rests against the left side of board 11 as seen in FIG. 1, and pad 24 of brake knob 23 of control element 17*b* rests against the right side of board 11.

When straightedge 25 is located at a desired position on top of board 11 the left and right side brake knobs 23*a* and 23*b* are turned inward to push their brake pads 24 against the sides of board 11 and thereby lock straightedge 25 at the desired position on board 11. When it is desired to move straightedge 25 up or down board 11 to a new position the two brake knobs are unscrewed a small amount to back off the brake pads 24 and thereby unlock the straightedge. Straightedge 25 is then slid up or down board 11 to a new position and the two brake knobs 23 are then turned inward to again push their brake pads 24 against the sides of board 11 and thereby lock straightedge 25 at the new position.

Figure 4:
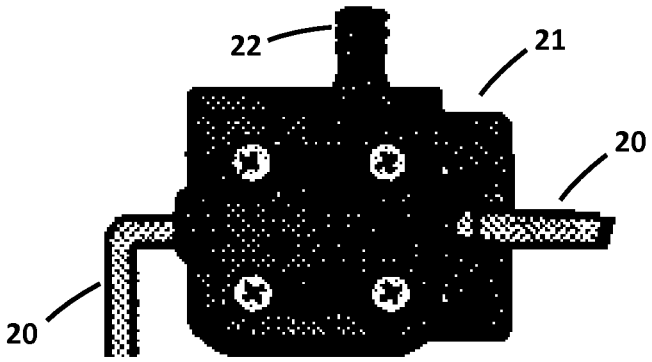
FIG. 4 is shown a lock mechanism that is used to maintain the drafting board in an inclined position when in use.

In FIG. 4 is shown a snap lock 21 two of which, 21*a* and 21*b*, are used to maintain the drafting board 10 in an upward inclined position, as shown in FIG. 1, when board 11 is in use. Rod 20 is formed into a rectangular loop as best shown in FIG. 2. Rod loop 20 is moved between a flat position against the bottom of board 11, as shown in FIG. 2, when board 11 is not is use, and to an upright position, as shown in FIG. 1, when board 11 is to be used.

Looped rod 20 passes through the two snap locks 21*a* and 21*b* and as rod 20 is rotated between its flat position against the bottom off board 11 and its upright position extending away from board 11 it rotates approximately ninety degrees in snap locks 21*a* and 21*b*. Snap locks 21*a* and 21*b* pinch rod 20 to lock it in whatever of the two positions selected by a user of drafting board 10. The locking and unlocking is accomplished by locking levers 22. The locked and unlocked position of locking levers 22 is shown in FIG. 2.

With the locking levers of 22*a* and 22*b* of the snap locks 21*a* and 21*b* in their unlock position looped rod 20 can be rotated within the two snap locks 21*a* and 21*b* between the position against board 11 (FIG. 2) and extended away from board 11 (FIG. 1). After handle 12 is moved to rotate looped rod 20 in snap locks 21*a* and 21*b* to extend its bottom end corners and feet 13*a* and 13*b* downward away from the bottom of board 11 locking levers 22*a* and 22*b* are moved as indicated in FIG. 2, as seen from the bottom of drafting board 10, to clamp looped rod 20 where it passes through snap locks 21*a* and 21*b* and thereby lock looped rod 20 with its feet 13*a* and 13*b* in the downward position as shown in FIG. 1.

When it is desired to rotate looped rod 20 up against the bottom of board 11 to store the board, the locking levers 22*a* and 22*b* are moved as shown in FIG. 2, as seen from the bottom of board 11, to unlock or unclamp looped wire rod 20 where it passes through snap locks 21*a* and 21*b*. After looped rod 20 is rotated up against the bottom of board 11 using handle 12 the levers 22*a* and 22*b* are moved to the their lock position to again lock looped rod 20 in its up or retracted position against the bottom of board 11.

In each of the four corners of board 11 is fastened a wire guide 15*a*, 15*b*, 15*c*, 15*d*, each wire guide consisting of a plate with a small pulley attached thereto. The axis of the shaft on which the pulleys are mounted extends downward from and perpendicular to board 11. There is also another, different wire guide 19 fastened to the bottom center of board 11. More particularly, each wire guide fits over one of the corner edges of board 11 before it is fastened to the underside of the board.

What has been described herein is a preferred embodiment of the invention but those skilled in the art will recognize that numerous changes may be made without departing from the spirit and scope of the invention.

The invention claimed is:

1. A drawing board assembly comprising:

a board having a top surface and a bottom surface, having a left edge and a right edge, and having four corners;

a pulley mounted in each of the four corners on the bottom surface of the board; and a flexible elongated member having two ends that is routed around the four pulleys such that a first portion of the elongated member is parallel to the left edge of the board and a second portion is parallel to the right edge of the board;

means for joining the two ends of the flexible elongated member and keeping it in tension; and a straight edge member on the top surface of the board, the straight edge having a left end and a right end, the left end riding along the left edge of the board and the right end riding along the right edge of the board;

wherein the left end of the straight edge member is attached to the portion of the elongated member that is parallel to the left edge of the board, and the right end of the straight edge member is attached to the portion of the elongated member that is parallel to the right edge of the board, and wherein as the straight edge member is moved from a first position on the top side of the board to a second position on top of the board it is always parallel to itself.

2. The drawing board assembly of claim 1 wherein the straight edge member comprises a first edge member mounted slidably on the left edge of the board;

a second edge member mounted slidably on the right edge of the board, and a straight edge bar having a first end that is attached to the first edge member and having a second end that is attached to the second edge member.

3. The drawing board assembly of claim 2 wherein the first edge member has a first locking means that is used to lock it to the left edge of the board, and a has a second locking means that is used to lock it to the right edge of the board, the first and second locking means being used to lock the straight edge bar to any selected position on the top surface of the drafting board.

4. The drawing board assembly of claim 3 wherein the first edge member comprises means for attaching it to the portion of the elongated member that is parallel to the left edge of the board, and the second edge member comprises means for attaching it to the portion of the elongated member that is parallel to the right edge of the board.

5. The drawing board assembly of claim 4 further comprising:

first means for fastening the first edge member to the left end of the straight edge bar, and second means for fastening the second edge member to the right end of the straight edge bar.

6. The drawing board assembly of claim 1 further comprising:

a first locking means that is used to lock the left end of the straight edge member to the left edge of the board; and a second locking means that is used to lock the right end of the straight edge member to the right edge of the board.

7. The drawing board assembly of claim 6 further comprising first means for attaching the left end of the straight edge member to the portion of the elongated member that is parallel to the left edge of the board, and second means for attaching the right end of the straight edge member to the portion of the elongated member that is parallel to the right edge of the board.

8. The drawing board assembly of claim 7 wherein the flexible elongated member comprises a piece of flexible wire and the means for joining the two ends of the flexible wire and keeping it in tension comprises a spring.

9. The drawing board assembly of claim 8 wherein the four pulleys comprise a first pulley under the top left corner of the board, a second pulley under the lower right corner of the board, a third pulley under the top right corner of the board, and a fourth pulley under the lower left corner of the board, and wherein the flexible wire passes around the first pulley, then the second pulley, then the third pulley, and finally the fourth pulley, and the two ends of the flexible wire are joined by the spring to keep the wire in tension.

10. The drawing board assembly of claim 9 wherein the tension spring is positioned under the middle of the bottom surface of the board when the straight edge member on the top surface of the board is mid-way between the top edge of the board and the bottom edge of the board.

11. The drawing board assembly of claim 1 wherein the flexible elongated member comprises a piece of flexible wire and the means for joining the two ends of the flexible wire and keeping it in tension comprises a spring.

12. The drawing board assembly of claim 11 wherein the four pulleys comprise a first pulley under the top left corner of the board, a second pulley under the lower right corner of the board, a third pulley under the top right corner of the board, and a fourth pulley under the lower left corner of the board, and wherein the flexible wire passes around the first pulley, then the second pulley, then the third pulley, and finally the fourth pulley, and the two ends of the flexible wire are joined by the spring to keep the wire in tension.

13. The drawing board assembly of claim 12 wherein the tension spring is positioned under the middle of the bottom surface of the board when the straight edge member on the top surface of the board is mid-way between the top edge of the board and the bottom edge of the board.

14. The drawing board assembly of claim 5 wherein the flexible elongated member comprises a piece of flexible wire and the means for joining the two ends of the flexible wire and keeping it in tension comprises a spring.

15. The drawing board assembly of claim 14 wherein the four pulleys comprise a first pulley under the top left corner of the board, a second pulley under the lower right corner of the board, a third pulley under the top right corner of the board, and a fourth pulley under the lower left corner of the board, and wherein the flexible wire passes around the first pulley, then the second pulley, then the third pulley, and finally the fourth pulley, and the two ends of the flexible wire are joined by the spring to keep the wire in tension.

16. The drawing board assembly of claim 15 wherein the tension spring is positioned under the middle of the bottom surface of the board when the straight edge bar on the top surface of the board is mid-way between the top edge of the board and the bottom edge of the board.

* * * * *